United States Patent [19]

Bergquist

[11] 4,259,816

[45] Apr. 7, 1981

[54] RESTAURANT FACILITY

[76] Inventor: Ron B. Bergquist, 1506 Blvd. at Six Corners, Sherwood, Oreg. 97140

[21] Appl. No.: 61,809

[22] Filed: Jul. 30, 1979

[51] Int. Cl.[3] ..... E04H 3/04

[52] U.S. Cl. ..... 52/33; 52/236.1

[58] Field of Search ..... 52/79.4, 236.1, 27, 52/33, 36

[56] References Cited

U.S. PATENT DOCUMENTS 217,054 3/1970 Neumeyer ..... D25/32

OTHER PUBLICATIONS

Architectural Record, Jan. 1971, p. 86.

*Primary Examiner*—John E. Murtagh

*Attorney, Agent, or Firm*—Kolisch, Hartwell & Dickinson

[57] ABSTRACT

A restaurant facility housed within an enclosure bounded by upright walls defining a perimeter for an enclosure of hexagonal outline. A kitchen and service station and table and seating structure within the enclosure are so organized that there is full visibility throughout the dining area. Waiters and patrons move in corridors providing access to tables and seats which are devoid of sharp corners.

10 Claims, 3 Drawing Figures

RESTAURANT FACILITY

BACKGROUND AND SUMMARY OF THE INVENTION

This invention relates to the construction of a restaurant and more particularly to the construction of such a facility which permits waiters and/or waitresses handling the needs of patrons of the facility to operate with maximum efficiency. Another feature of the construction is that all areas in which patrons are being served are observable from a single station, which may be the cashier's station. This is important if proper supervision of employee personnel in the restaurant is to result, and in making sure that patron's needs are being taken care of.

In recent years, it has become increasingly the custom of Americans to "dine out", which has resulted in a considerable expansion in the number and types of restaurants which are available for dining purposes. Along with this expansion, competition between different restaurant has grown, with increasing interest being paid to the handling of restaurant patrons in a coordinated and efficient manner, whereby a patron may feel that he or she has been served with rapidity and due attention, and such service is obtainable with minimal waiter personnel.

Important factors in the conception of this invention were the observation that a waiter's efficiency is closely related to the ease with which he can move about the dining area assigned to him, the distance that must be traveled in obtaining food orders, and the access provided a waiter in moving throughout the area he serves. Waiter service stations should be conveniently available, and all areas served by a waiter should be open and visually within the sight of a waiter. A waiter should feel that he may move quickly throughout the area he serves, without fear of collision. With proper visibility, a waiter is constantly aware of the patrons that he is serving, and each patron therefore is assured of prompt service when a need arises.

This invention is more specifically based on the further observation that a major factor in waiter fatigue, the dropping of food servings, collisions, and other accidents which are the concerns of any restaurant, is the prevalence in most restaurants of right-angle corners in corridors provided for waiter and customer travel. If such corridors have substantial width, such problems tend to be minimal, but prudent use of space militates against the provision of wide corridors. It has been observed, for instance, that corridors of 3 to 3½ feet in width are ample to provide customer and waiter access to an eating area, if the corridor does not include sharp corners and obstructed vision. In a facility, as contemplated by the present invention, movement by a waiter from a waiter station to restaurant patrons within his service area, when such involves a change in direction, is over a relatively wide angle and with full visibility provided of regions beyond the turn, enabling the provision of a corridor accomodating people movement of reduced width.

An object of the invention, therefore, is to provide an improved construction for a restaurant which promotes maximum efficiency in the use of space accompanied with maximum efficiency in people movement throughout the space.

Another object is to provide a restaurant construction organized so that employees working in the restaurant are readily observable by a supervisor. In fact, by locating a cashier station near the entrance to the facility, a person located at this station can readily observe all dining areas as well as kitchen personnel.

Yet another object is to provide such a restaurant facility which has an attractive and pleasing appearance, and is capable of being identified by a customer as associated with a particular food dispenser.

Yet another object is to provide a restaurant facility which, for a given size, is capable of efficiently handling a far greater number of patrons than is practicable with conventional constructions.

These and other objects and advantages are attained by the invention, which is described hereinbelow in conjunction with the accompanying drawings, wherein.

DETAILED DESCRIPTION OF THE INVENTION

Figure 2:
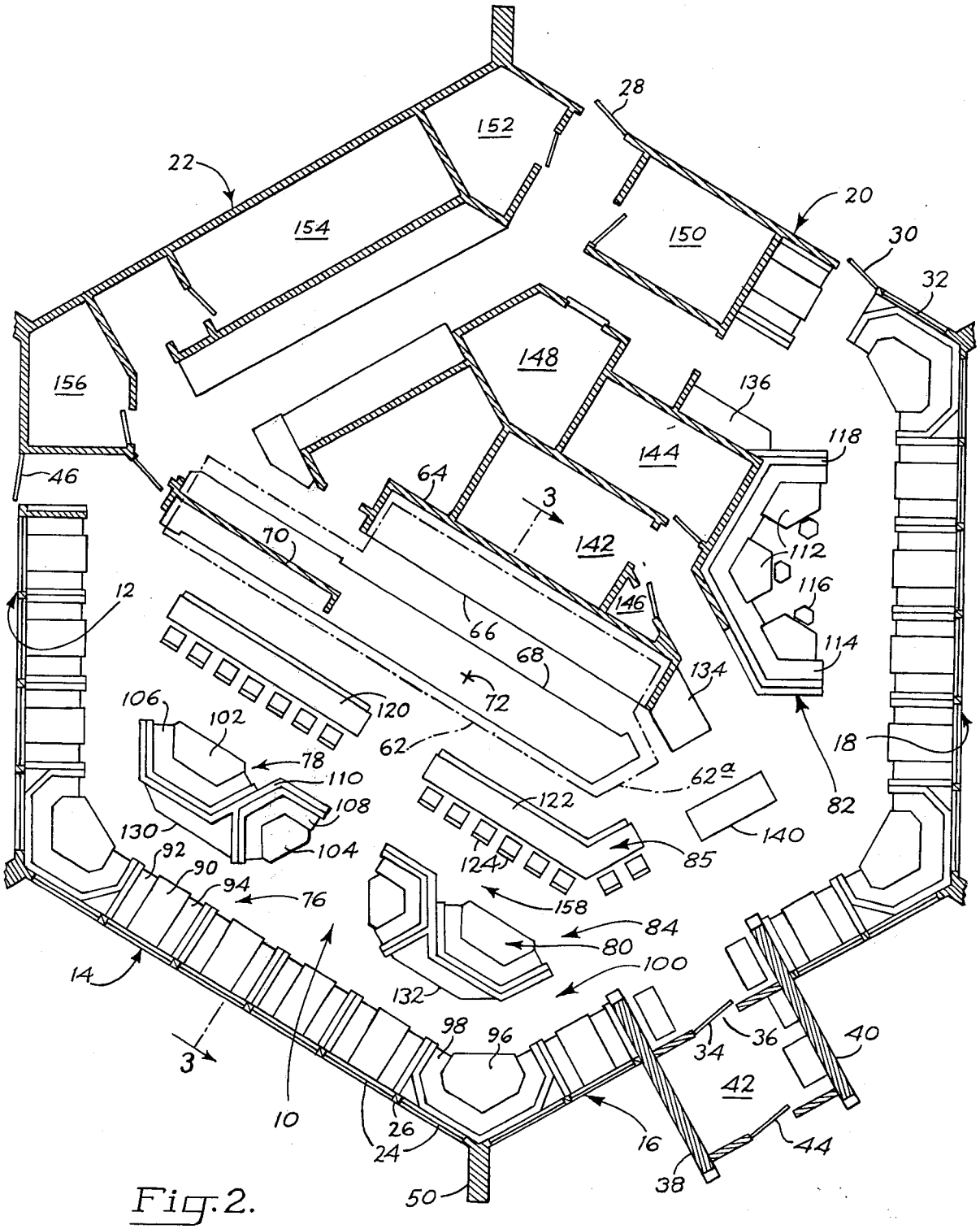
FIG. 2 is a simplified plan view of the restaurant facility illustrated in FIG. 1 on a slightly smaller scale.

Referring now to the drawings, as is evident from reviewing FIG. 2, the restaurant facility of the instant invention includes a dining area indicated generally at 10, within an enclosure having a perimeter defined by upright walls of substantially equal length disposed at 120° angles with respect to each other. In the building illustrated, six of such walls are shown, indicated at 12, 14, 16, 18, 20, and 22, forming the perimeter of an enclosure of hexagonal outline.

The walls of the enclosure have differing constructions dictated by the functions that they serve. Thus, walls 12, 14, 16, and 18 which bound the dining area for the most part comprise windows such as windows 24, separated by stanchions 26. Walls 20 and 22 bound an area within the enclosure usable to house what is referred to herein as restaurant support facilities (located at the upper part of the drawing in FIG. 2), and these may be imperforate or substantially so. In the particular construction illustrated in FIG. 2, wall 22 is a solid wall. Wall 20 has a pair of doors, namely door 28 useable as a service entrance and door 30 useable as a customer exit, as well as one window shown at 32.

Wall 16, midway between the ends thereof, is provided with an entrance door 34 which closes an entrance 36 to the restaurant facility. If desired, a pair of opposed stanchions 38, 40 may be included adjacent the entrance door which stanchions partially support roof structure in the facility and also define opposite sides of a foyer 42 leading to the entrance. Providing an entrance to the foyer is a foyer door 44.

Wall 12 may further include a door, such as shown at 46, providing a customer exit from one end of the dining area (door 30 providing an exit at the opposite extremity of the dining area).

Figure 1:
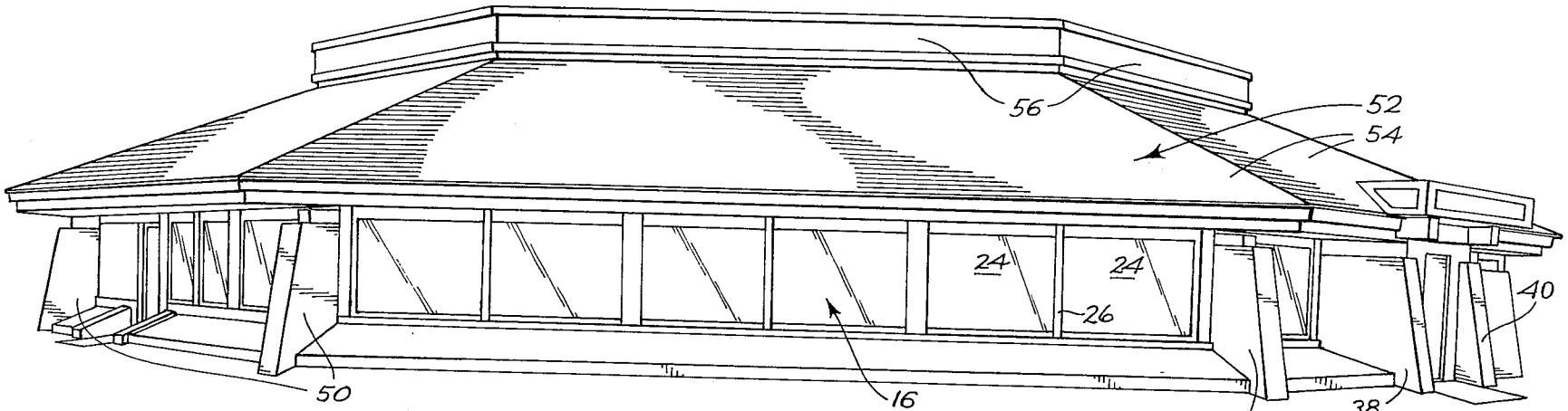
FIG. 1 is a side exterior view of a restaurant facility constructed according to this invention.
Figure 3:
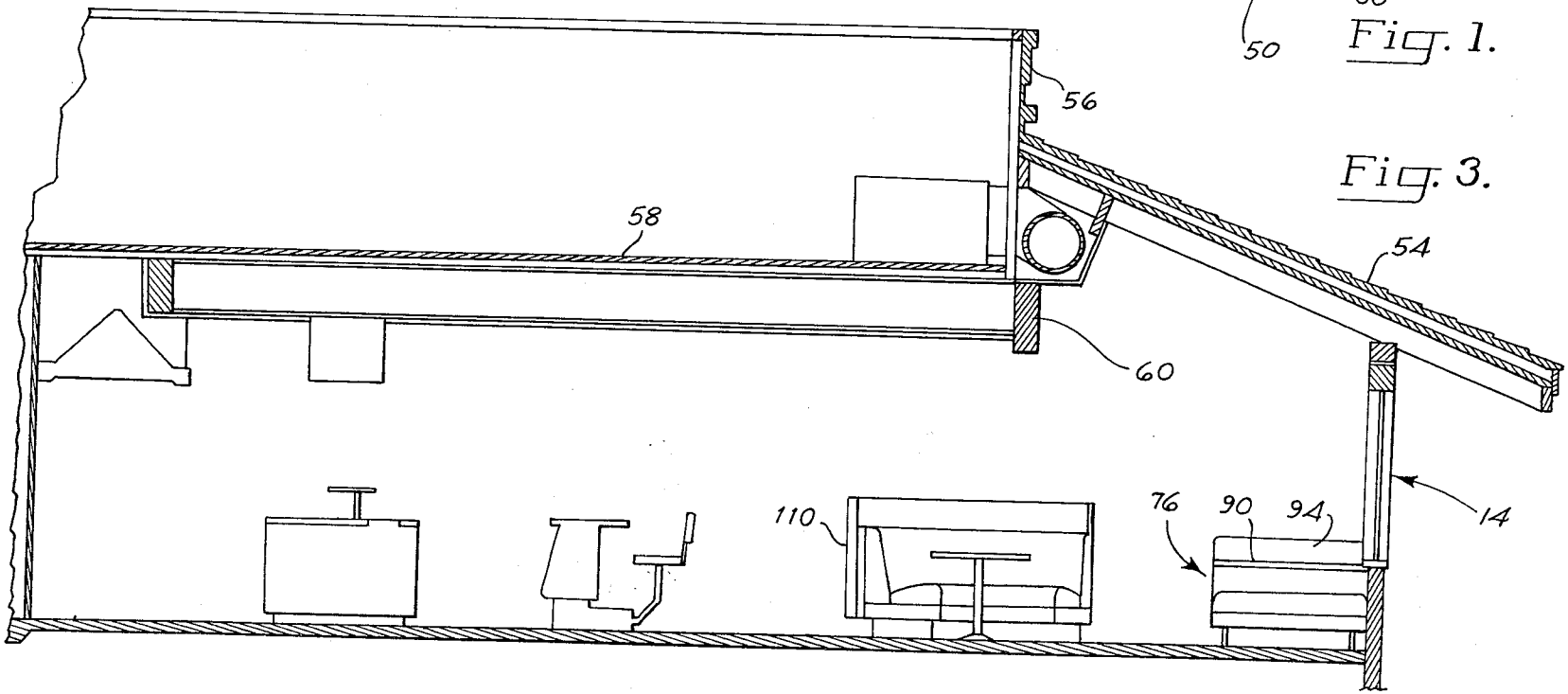
FIG. 3 is a cross-sectional view, on a larger scale, taken generally along the line 3—3 in FIG. 2.

Referring now to FIG. 1, at each corner of the building illustrated a stanchion exemplified by the stanchions shown as 50 may be provided, and these stanchions collectively provide support for roof structure indicated at 52. The particular roof structure illustrated includes sloping roof sections 54 sloping upwardly progressing inwardly from a side wall. These converge on facade sections 56 bounding a sunken flat roof section 58 which (see FIG. 3) covers the central portion of the enclosure in the restaurant facility. The roof structure derives its support from the stanchions through suitable beams such as beam 60, details of the roof support not being required for an understanding of the invention. Suffice it to say that in a preferred form of the invention, the roof is supported by stanchions located exteriorally of the hexagonal space defined by the walls, thus to render unnecessary stanchions or other means within the enclosure for roof support which would have the effect of obstructing visibility in the area of the building reserved for dining.

Referring again to FIG. 2, shown outlined by the dotdash line 62 is an elongate kitchen and serving station provided in the facility. It will be noted that such extends across substantially the center of the enclosure defined by the walls 12 through 22. It will also be noted also that such occupies a zone extending from the corner formed by wall 16 (which has the entrance to the restaurant facility) and wall 18 which follows, to a corner diametrically opposite, i.e., the corner formed by the juncture of walls 12 and 22. One end of this kitchen and serving station, i.e., and 62*a*, is opposite but spaced inwardly from entrance 36 to the facility. The opposite end of the kitchen and serving station is adjacent and disposed inwardly from the corner defined by walls 22 and 12. Thus, the kitchen and serving facility substantially bisects the interior of the enclosure. The front side of the station, i.e., where food is disensed for serving to patrons, faces downwardly in FIG. 2. The rear side of the station is bounded by upstanding wall structure 64 (which may be ceiling height) separating the kitchen and serving station from the restaurant support facilities located rearwardly of the station.

The kitchen and serving station may be provided with the usual equipment which makes up such a station in a restaurant. Thus, line 66 indicates one edge of a counter area which may be provided with shelving, griddles, burners, soup wells, food warmers, broilers, French fryers, etc., this constituting the cooking line in the station. Outlined at 68 and bisected by a wall 70 adjacent one end of the kitchen and serving station is the service line, which may include such equipment as mixers, work counters, waffle bakers, refrigerators, microwave ovens, ice cream cabinets, pie displays, milk shake mixers, etc. Meals prepared in the kitchen and serving station are dispensed to waitresses and waiters for pick-up approximately at the location marked at 72 in the drawing.

With continued reference to FIG. 2, within the dining area which accommodates the patrons of the restaurant is table and seating structure which includes a table and seating row 76 extending in a path paralleling walls 12, 14, 16, 18 and part of wall 20 along the perimeter of the dining area. Such structure also includes a table and seating row 84 made up of table and seating islands shown at 78, 80 and 82, and a table and seating 84.

Table and seating row 76 may include tables exemplified by table 90, and opposed bench type seats 92, 94 accommodating the seating of restaurant patrons on either side of a table. At corners of the dining area, alcove seating is provided by table 96 and an elongate bench extending in an angular course about a major part of the table, shown at 98. An elongate corridor 100 parallels this table and seating row 76 throughout the length of the table and seating row, providing access to the tables and seats of the row by patrons of the restaurant and waiters and/or waitresses handling the demands of these patrons.

Table and seating islands 78, 80 each provide alcove seating about a pair of tables shown at 102, 104. Elongate bench 106 provides seating for table 102, and elongate bench 108 seating for table 104. Separating the two tables and benches is a divider 110, preferably of no more than 4 or 4½ foot height, whereby the divider provides semiprivacy for the occupants of the tables but does not interfere with someone viewing the dining area from a standing position, i.e. someone walking down the corridor space or attending to supervision of restaurant details.

Island 82 includes a somewhat different organization of tables 112, bench 114, and seats 116. Again the perimeter of this island may be bounded by a divider 118 of limited height as described in connection with divider 110.

Row 85 includes two separate counters 120, 122 separated by a path which provides access to dispensing station 72. Seats for the counters are indicated at 124.

Indicated at 130, 132, 134 and 136 are waiter service stations. These may include the usual equipment which a waiter utilizes in setting up and clearing a table such as silverware, glasses, etc.

Indicated at 140 is the cashier's station of the restaurant. A person manning the cashier station has an unobstructed view of the entire dining area, which is to say over the extent of table and seating row 76, the counter table and seating row 85, and table and seating row 84.

Restaurant support facilitaties have earlier been mentioned located rearwardly of wall 64. Very briefly describing such, in the floor plan illustrated in FIG. 2, restrooms are indicated at 142, 144, and a closet area at 146. Indicated at 148 is a freezer area. A storage room is indicated at 150, a locker room and employees' restroom at 152, an additional storeroom at 154, and an office at 156. All these rooms are bounded by ceiling height walls and have doors providing suitable access.

With the construction described, as earlier explained, a corridor is provided which extends the length of the table and seating row 76. The corridor where such passes the table and seating islands may have a width of about three feet, which is sufficient to accommodate patron passage and the movement of waiters. Where the corridor angles, the turn that the waiter negotiates is over a 120° angle, by reason of the setting of the walls, which is an easy angle to negotiate as compared to the right angle corner which normally is present in a restaurant. Full visibility is provided to a person approaching a turn as to what lies beyond the turn, and a person may move throughout the area without apprehension as to opposing traffic. A similar corridor 158 is provided between the table and seating islands 78, 80 and the counter and seating structure 85. Again, a waiter moving from corridor 100 into corridor 158 travels over a wide 120° angle, with full visibility of any approaching traffic.

Waiters handling the dining area, in order to pick up dishes to be served to patrons, travel to a dispensing station which is located substantially centrally of the facility, which tends to equate the distance traveled for all the waiters in the facility.

A supervisor, for example a person occupying the cashier's station, has an unobstructed view of the entire dining area as well as the kitchen and serving station which is located directly behind it. Any hostess provided to handle incoming patrons has a similar unobstructed view of the entire dining area.

Because the construction described enables the width of the various corridors to be minimized, the dining area may be provided with maximum seating.

It is claimed and desired to secure by Letters Patent:

1. In a restaurant facility, upright walls of substantially equal length defining an enclosure for the patrons of the facility, the walls being set at approximately 120° angles with respect to each other, thus to define the perimeter of an enclosure following hexagonal outline, an entrance to said enclosure extending through one of said walls, table and seating structure within said enclosure including a table and seating row extending in an elongate path which parallels said walls and extends to either side of said entrance and throughout at least half of the perimeter of said enclosure, an elongate corridor substantially coextensive in length with said row paralleling said row, and disposed inwardly of said row which corridor provides access to said row, an elongate kitchen and serving station extending across substantially the center of said enclosure facing said row and having one end remote from said entrance and an opposite end which is spaced opposite said entrance, and restaurant support facilities located to the rear of said kitchen and serving station.

2. The restaurant facility of claim 1, wherein said elongate kitchen and serving station substantially parallels another of said walls, which other wall joins at one end with said one wall, and which further comprises a second table and seating row paralleling said other wall disposed inwardly of said corridor.

3. The restaurant facility of claim 2, wherein said second table and seating row is separated from said corridor by another table and seating row, and another corridor paralleling said first-mentioned corridor separates said second and said other table and seating row.

4. The restaurant facility of claim 1, wherein a waiter-waitress service station is provided facing said first-mentioned corridor at points distributed along the length of said corridor.

5. The restaurant facility of claim 1, wherein said table and seating row extends in a path paralleling four walls of said enclosure, said elongate corridor parallels said four walls, and said enclosure is devoid of internal walls throughout the space in said enclosure disposed forwardly of the kitchen and serving station and occupied by said corridor and said table and seating structure.

6. In a restaurant facility, six upright walls of substantially equal length joined end-to-end to provide six corners in the facility and forming the perimeter of an enclosure having hexagonal outline, an entrance to said enclosure extending through one of said walls, an elongate kitchen and serving station occupying a zone extending from a corner formed by one end of said one wall and an end of a following wall, to a diametrically opposite corner, said station crossing substantially the center of the enclosure and having one end opposite but spaced inwardly from said entrance and an opposite end adjacent but disposed inwardly from said opposite corner, said station facing the wall in said facility which joins with the other end of said one wall, and table and seating structure distributed in the space within said enclosure which extends from said opposite corner past the front of the kitchen and serving station to the corner appearing at the other end of said following wall.

7. The restaurant facility of claim 6, which further further includes restaurant support facilities located to the rear of said kitchen and serving station.

8. The restaurant facility of claim 6, wherein said table and seating structure includes a table and seating row adjacent and paralleling the walls of the enclosure which bound said space.

9. The restaurant facility of claim 6, wherein said table and seating structure includes a table and seating row adjacent and paralleling the walls of the enclosure which bound said space, and which further includes a corridor paralleling said row disposed inwardly of the row providing access to the row.

10. The restaurant facility of claim 6, wherein said space is devoid of internal walls.

* * * * *